US006053363A

United States Patent [19]

Revenu

[11] Patent Number: 6,053,363

[45] Date of Patent: Apr. 25, 2000

[54] PACKAGING AND DISPENSING ASSEMBLY FOR A COSMETIC, PHARMACEUTICAL OR DERMO-PHARMACEUTICAL PRODUCT

[75] Inventor: Christian Revenu, Paris, France

[73] Assignee: L'Oreal, Paris, France

[21] Appl. No.: 09/256,208

[22] Filed: Feb. 24, 1999

[30] Foreign Application Priority Data

Feb. 24, 1998 [FR] France ..... 98 02205

[51] Int. Cl.[7] ..... B67D 5/00

[52] U.S. Cl. ..... 222/82; 222/88; 222/183; 222/321.1; 222/325; 222/372

[58] Field of Search ..... 222/183, 321.1, 222/321.7, 372, 383.1, 325, 82, 88

[56] References Cited

U.S. PATENT DOCUMENTS

| | | | |
|---|---|---|---|
| 3,412,900 | 11/1968 | Macaulay | 222/82 |
| 3,622,053 | 11/1971 | Ryden . | |
| 3,934,761 | 1/1976 | Gentreau | 222/183 |
| 4,076,147 | 2/1978 | Schmit | 222/183 X |
| 4,936,487 | 6/1990 | Mader et al. | 222/183 X |
| 5,358,147 | 10/1994 | Adams et al. | 222/183 |
| 5,516,006 | 5/1996 | Meshberg | 222/183 X |
| 5,595,326 | 1/1997 | Bougamont et al. . | |
| 5,875,934 | 3/1999 | Miller et al. | 222/183 |

FOREIGN PATENT DOCUMENTS

| | | |
|---|---|---|
| 2 504 891 | 11/1982 | France . |
| 1 625 201 | 2/1970 | Germany . |

*Primary Examiner*—Kenneth Bomberg
*Attorney, Agent, or Firm*—Oblon, Spivak, McClelland, Maier & Neustadt, P.C.

[57] ABSTRACT

An assembly (1) for packaging and dispensing a product includes a reservoir (20) containing a product, and an external casing (2) on which is mounted a pump. The external casing (2) being capable of receiving said reservoir (20) through an opening (4) made in the bottom of the casing. The casing (2) includes a fastener portion for interacting with a corresponding fastener portion of the reservoir so as to effect reversible fastening of the reservoir (20) in the external casing (2) and to maintain the communication of the pump (16) with the reservoir through an opening of the reservoir. According to the invention, the external casing (2) has, in the vicinity of its bottom, at least one cutout (33) capable of assisting the removal of the reservoir (20), in particular for the purpose of replacing the reservoir.

20 Claims, 2 Drawing Sheets

FIG.4
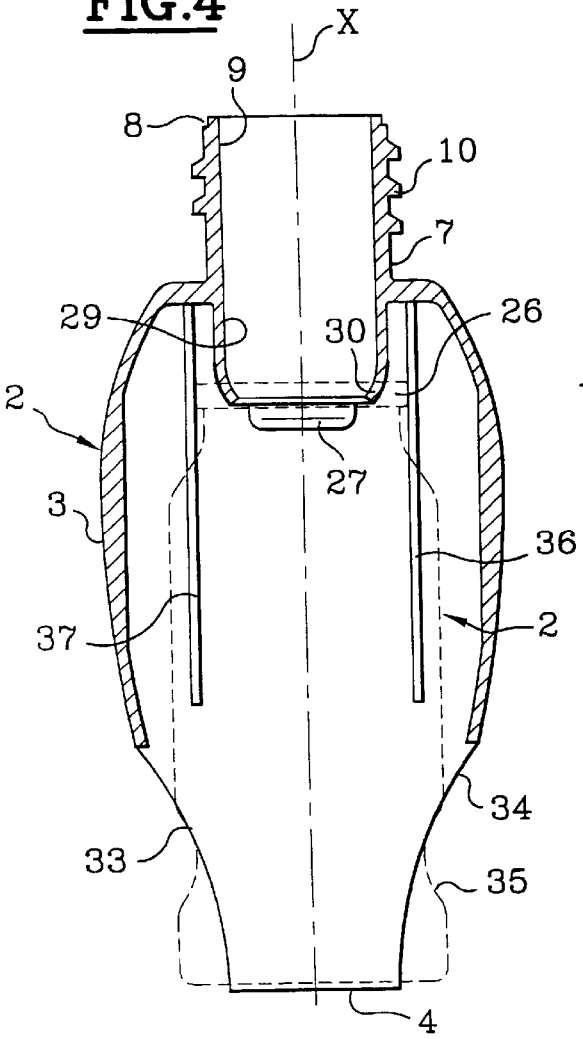
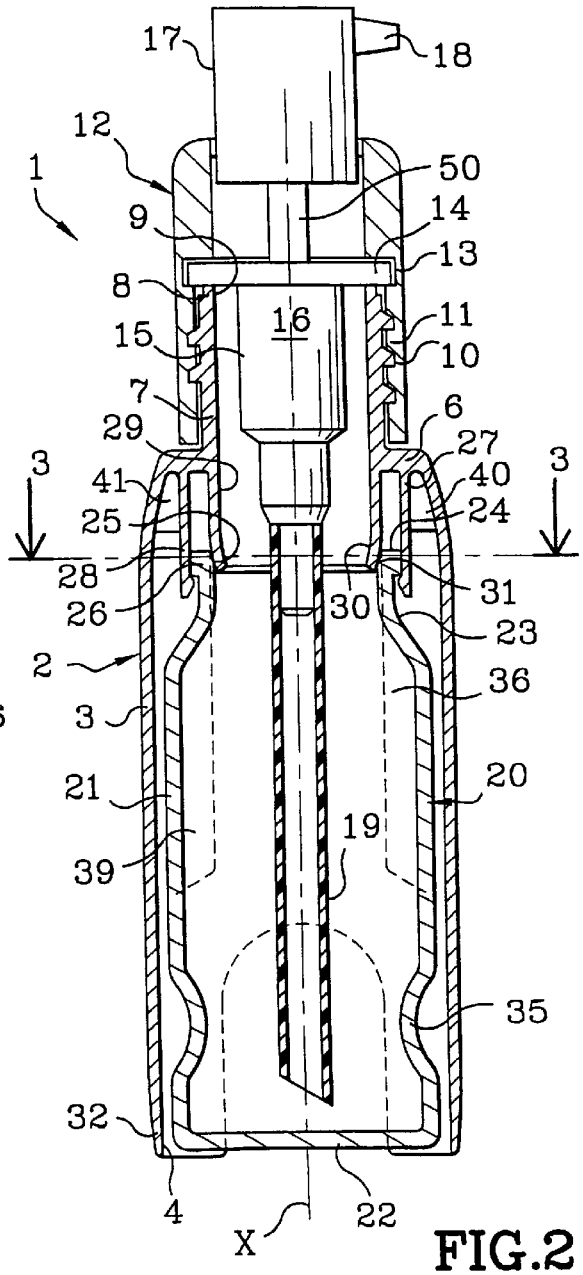
FIG.2
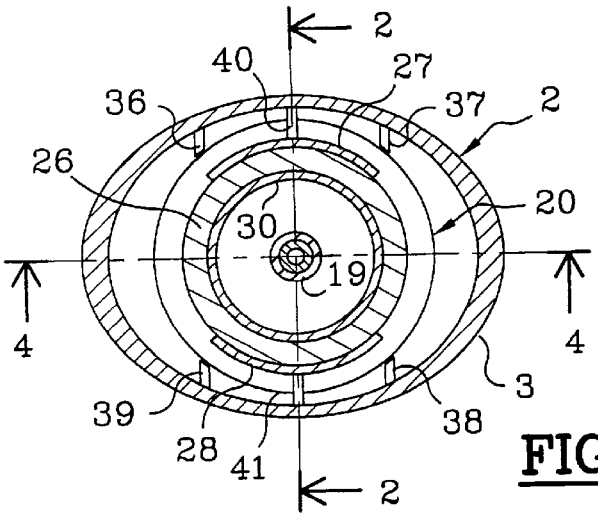
FIG.3

PACKAGING AND DISPENSING ASSEMBLY FOR A COSMETIC, PHARMACEUTICAL OR DERMO-PHARMACEUTICAL PRODUCT

BACKGROUND OF THE INVENTION

1. Field of the Invention

The present invention relates to an assembly for packaging and dispensing a product, and in particular, packaging for a liquid or creamy product such as a pharmaceutical or dermo-pharmaceutical product.

More specifically, the invention relates to a packaging and dispensing assembly which includes a pump mounted on an external enclosure for receiving a product reservoir, such as a refill insert containing a single dose of a given product.

2. Description of the Related Art

European Patent No. A-0 638 367 teaches a refillable packaging and dispensing assembly, which includes a reservoir for the product, a neck, and a rigid casing surrounding the reservoir and having an opening through which the neck of the reservoir protrudes. A pump is threadedly engaged onto the neck of the reservoir.

For such assemblies, it is desirable that replacement of the refill can be performed as simply and quickly as possible. Moreover, the cost of the disposable part of the assembly, in this case the refill, must be as low as possible. However, it has been found that replacing the product reservoir to refill the container of the conventional container, requires a certain number of time-consuming operations. Such operations include unscrewing, insertion, positioning and manual holding of the refill, and lastly screwing the pump back on.

Also known in the art is a dispenser which includes a casing surrounding a reservoir, and a dispensing pump crimped to the upper part of the casing. The pump includes an actuating shaft housed in a dispensing duct arranged in the casing. A lower portion of the reservoir projects a considerable extent from the casing so that the reservoir (including the pump) can be taken hold of easily and be replaced easily by a new reservoir. However, it has been found that this device has several disadvantages. One disadvantage associated with this design is related to its aesthetic quality, due to the protruding part of the reservoir. Moreover, to operate the pump, the user has to use a thumb to press the bottom of the reservoir to make it slide in the casing so as to eject a dose of product while holding the top part of the casing with the middle finger or the index finger. Accordingly, the height of the reservoir must be limited because this device can no longer be used properly when it has a height in excess of approximately 8 cm to 10 cm. If its height were any greater, many people would not be able to use the container since their hand would be too small to properly operate the pump. Moreover since the device is held between the thumb and the index finger of the user during use, treatment of certain parts of the body is impossible or at least difficult, in particular, lower parts of the body.

SUMMARY OF THE INVENTION

The present invention provides a dispensing assembly which does not have the disadvantages of the existing dispensers mentioned above.

An object of the invention is to provide a dispenser which can be refilled simply and easily and which includes an inexpensively manufactured disposable portion.

According to the invention, these and other objects are achieved by an assembly for packaging and dispensing a product, in particular a liquid product, which includes a reservoir for a product, having a body with one end closed by a bottom and a second end with a free edge delimiting an opening, and an external casing, on which is mounted a pump. According to the present invention, the external casing is surmounted by actuating and dispensing means, and is configured to receive the reservoir in a removable manner through an opening made in the bottom of the casing. Furthermore, the casing is configured to enclose the reservoir over substantially its entire height. Additionally, the casing includes means for interacting with corresponding means on the reservoir so as to effect reversible fastening of the reservoir in the casing and to maintain the communication of the pump with the reservoir through said opening. Preferably, the external casing has, in the vicinity of its bottom, at least one cutout capable of assisting the removal of the reservoir, in particular, for the purpose of replacing the reservoir.

Advantageously, the cutout delimits elastically deformable portions which improve the retention of the reservoir in the casing. To this end, the opening in the bottom of the casing may be delimited by a rim which has a diameter that is smaller than the maximum diameter of the reservoir. As the reservoir is inserted past the rim, the portions defined by the cutouts elastically deform so as to allow the reservoir to pass. Preferably, the cutouts open into the opening of the bottom of the casing. The profile of the rim formed by the bottom of the casing can be selected so as to stress the reservoir in bearing contact in the direction towards the pump.

The fastening means may consist of at least one elastically deformable member which is capable of interacting by elastic deformation with a flange formed in the vicinity of the free edge of the reservoir. Such fastening means may consist of a plurality of regularly spaced skirt portions.

According to a preferred embodiment, the casing comprises, in the vicinity of its end on which the pump is mounted, a skirt having a free end capable of coming into liquid-tight contact with the opening of the reservoir so as to bring about liquid-tightness between the reservoir and the pump. Preferably, the skirt has its free end forming a rim curved inwardly in the direction towards the longitudinal axis of the assembly and is dimensioned so that the inwardly curved rim is in liquid-tight bearing contact with a chamfered portion formed on the internal surface of the free edge of the reservoir. Since there is only a partial engagement of the liquid-tight skirt in the neck of the reservoir, problems associated with manufacturing tolerances are eliminated.

More advantageously, a guide is provided in order to effect guidance of the reservoir when it is being inserted into the casing and to improve its retention in said casing. Such a guide may consist of a plurality of blades which are arranged on the internal surface of the lateral walls of the casing and whose free ends are arranged so as to enter into elastic engagement with the lateral walls of the reservoir along at least one line of contact.

Preferably, said blades are arranged in a plane that does not pass through the longitudinal axis of the assembly. According to a particular embodiment, the external casing has at least one part with an oblong cross section having a mjor and a minor axis, wherein the blades are arranged in planes substantially perpendicular to major axis. Therefore, by making use of the elasticity and the orientation of the blades, manufacturing tolerance problems are eliminated, ensuring good retention of the reservoir irrespective of the slight dimensional variations of the casing and/or of the reservoir within normal manufacturing tolerances. Radially oriented blades, as are made conventionally, could not achieve such a result.

According to a preferred embodiment, the casing includes two cutouts which substantially form a "U" shaped opening into the opening of the bottom of the casing, the two cutouts being arranged diametrically opposite one another. Therefore, by gripping the bottle between the thumb and the index finger, in the region of the "U"-shaped cutouts, the user can easily withdraw the bottle by a movement axially in relation to the external casing.

The pump can be provided with a plunger tube which, when the reservoir is put in place in the casing, is capable of piercing a protective cap closing the opening of the reservoir. Such a protective cap may be formed of a metal foil made of aluminum, or of a composite formed by at least one thermoplastic foil and one metal foil, for example. Furthermore, the protective cap can be applied to the free edge of the reservoir by an appropriate process such as heat sealing. Preferably, the plunger tube consists of a rigid material, the free end of the plunger tube being shaped into a point so as to be capable of piercing the protective cap when the reservoir is inserted into the casing.

The reservoir is preferably made of glass, in consideration of compatibility with the contents of the reservoir and for reasons of preservation of the contents.

According to another advantageous characteristic of the invention, the bottle includes, facing the cutout(s), a profile capable of facilitating its being gripped. Such a profile may be formed by a hollow part running around the reservoir, or by any other relief.

Preferably, the pump can be screwed onto the casing. Any other appropriate method of mounting the pump on the casing may be envisaged, for example, the pump may be fixed by snap-connection, gluing etc.

The assembly according to the invention that has just been described can be used in particular, for packaging and dispensing a cosmetic product, such as a hair product, a pharmaceutical product or a dermo-pharmaceutical product, for example.

BRIEF DESCRIPTION OF THE DRAWINGS

Apart from the arrangements explained above, the invention consists of a certain number of other arrangements which are explained below in connection with non-limiting exemplary embodiments described with reference to the appended Figures, in which:

FIG. 2 shows a longitudinal sectional view in of the assembly illustrated in FIG. 1;

FIG. 3 shows a cross-section of the assembly according to the plane 3.—3. in FIG. 2, and FIG. 4 shows a longitudinal section according to the plane 4.—4. in FIG. 3.

DETAILED DESCRIPTION OF THE PREFERRED EMBODIMENTS

Figure 1:
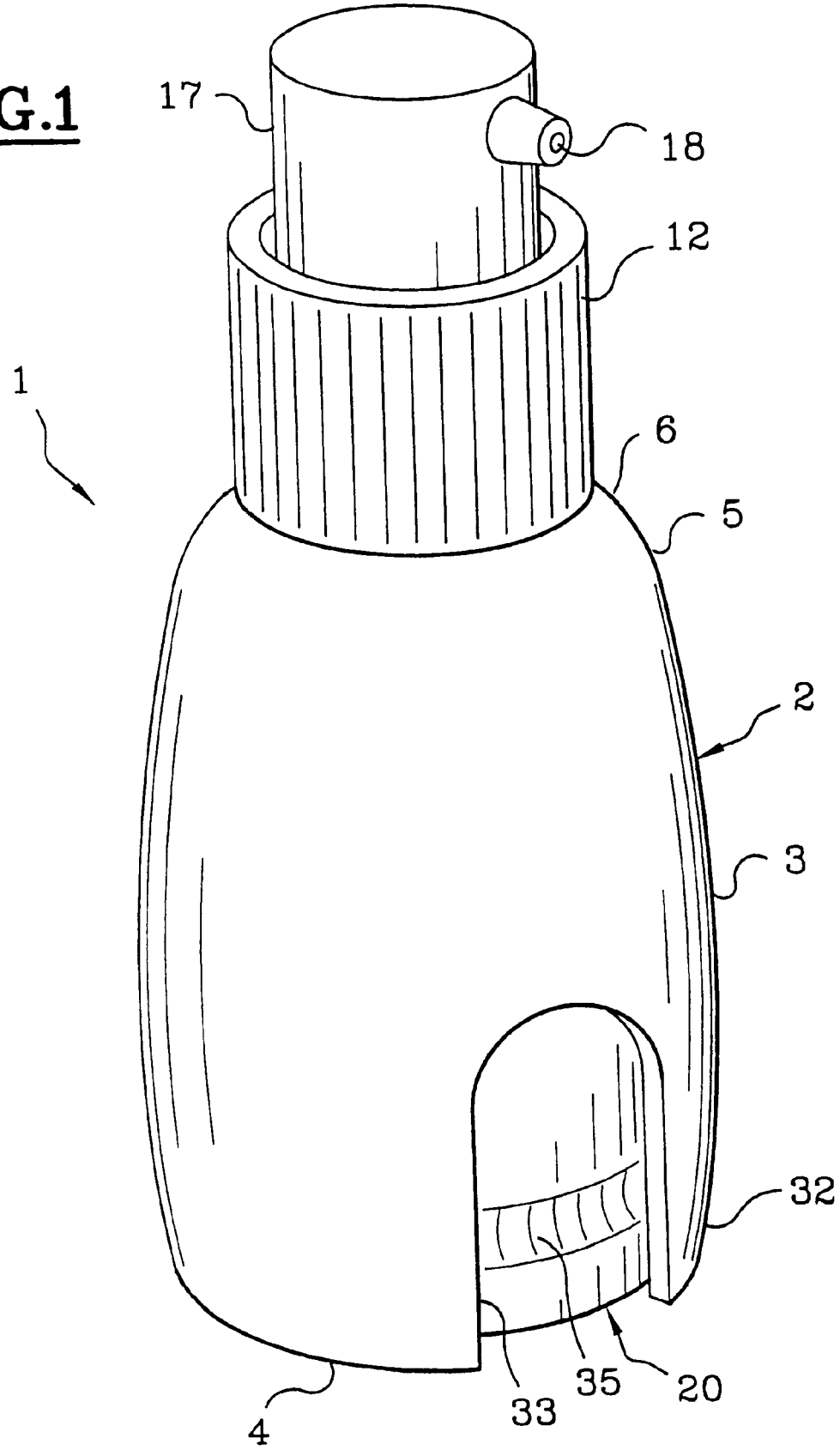
FIG. 1 is a perspective view of a packaging and dispensing assembly according to the invention.

As is shown in FIGS. 1 to 4, the assembly 1, according to one embodiment of the invention, having a longitudinal axis X includes an external casing 2 obtained by molding a thermoplastic material such as a polypropylene or a polyethylene, for example. The casing includes a body 3 which is approximately circular in the vicinity of the lower end 32 of the external casing 2, then changes gradually to become substantially elliptical in the direction of its upper end 5, opposite the bottom 4. A shoulder 6 connects the body 2 to a neck 7, which includes a free edge 8 delimiting an opening 9. The lower end 32 of the casing also has a free edge delimiting an opening 4 which allows the insertion of a reservoir 20 into the external casing (described in detail below). Preferably, the section of the lower end 32 of the casing is substantially equal to that of the bottom of the reservoir 20, so as to ensure elastic retention of the reservoir 20 in the external casing, thus improving the overall retention of said reservoir in the assembly 1.

On its external surface, the neck 7 includes a thread 1 0 capable of interacting with a corresponding thread 11 provided on the internal surface of mounting piece 12. On its internal surface, the mounting piece 12 comprises an annular groove 13 configured to receive a plate 14 for sealing a pump body 15. Pump 16 includes a protruding shaft 50, on which a push-button 17 is mounted, which ends in a dispensing orifice 18. Pump 16 may be mounted by force-fitting in the mounting piece 12 and retained in mounting piece 12 by virtue of the interaction between plate 14 and annular groove 13. As shown in FIG. 2, the walls of the mounting piece 12 are of greater thickness above the annular groove 13 so as to guide the push-button 17 in when it is being pressed downwardly, as viewed in FIG. 2, to operate the pump 16.

Pump 16 also includes a plunger tube 19, which is configured to be inserted into the reservoir 20 and whose free end extends substantially as far as the bottom of the reservoir 20. Preferably, although not shown, before insertion into the casing 2, reservoir 20 is sealed by a protective cap. Preferably, the protective cap is heat-sealed and aluminium-based. The plunger tube is preferably sufficiently rigid to pierce the heat-sealed protective cap when the reservoir is being inserted, thereby reducing the number of operations necessary for installing a new refill into the assembly. Moreover, as shown in the Figures, the free end of the plunger tube has a bevelled profile so as to assist piercing of the protective cap.

Arranged inside casing 2, is a reservoir 20 in the form of a bottle, which comprises a cylindrical body 21 closed by a bottom 22 and which has a neck 23 ending in a free edge 24 defining an opening 25. Reservoir 20 is sized such that, in the mounted position illustrated in FIG. 2, it is surrounded over substantially its entire height by casing 2. Preferably, reservoir 20 consists of a glass bottle. Neck 23 has an external flange 26 which is configured to interact by snap-connection with two diametrically opposite skirt portions 27, 28 supported by the shoulder 6 of casing 2. The rigidity of the skirt portions 27, 28 is improved by tabs 40, 41 which connect the skirt portions 27, 28 to the lateral wall of the casing 2. In extension of neck 7, the external casing 2 comprises a liquid-tight skirt 29, a free end of which ends in a rim 30 which is curved radially inwardly towards the longitudinal axis X so as to come into liquid-tight contact with a chamfered portion 31 provided on the internal surface of the free edge 24 of the reservoir 20.

In the vicinity of its lower end 32, casing 2 comprises at least two U-shaped cutouts 33, 34 which open into the opening 4. These cutouts facilitate gripping of the reservoir 20 not only when it is inserted but also, advantageously, when it is removed for the purpose of its replacement by a full reservoir. Preferably, cutouts 33, 34 extend over a height equal to approximately a third of the height of external casing 2. Cutouts 33, 34 may be made on the front or rear faces, or on the lateral faces of the external casing. Cutouts 33, 34 may be formed by molding with the rest of casing 2. Advantageously, the glass bottle 20 has, in the vicinity of its bottom, an annular depression 35 which enhaces the gripping of the bottle through the cutouts 33, 34 when it is removed for the purpose of its replacement by a new refill. Annular depression 35 is arranged so that, in the mounted position of the reservoir 20 inside casing 2, depression 35 faces cutouts 33, 34.

Similarly, according to another advantageous characteristic of the invention, which is independent of the characteristic relating to the gripping cutouts, casing 2 is provided with blades 36–39 arranged so that their free ends enter into elastic engagement with the reservoir when the reservoir is mounted in the device, as shown in FIG. 3. Advantageously, blades 36–39 are arranged to face each other in pairs, and extend respectively in planes that do not pass through the longitudinal axis X of the device. In the embodiment illustrated, the planes are perpendicular to the major axis (coincident with section line 4.—4. shown in FIG. 3) of the portion of casing 2 which has an oblong cross section, the reservoir 20 itself being of circular cross section. Such blades allow the reservoir 20 to be guided when it is being inserted into the external casing 2. Moreover, by their arrangement, blades 36–39 eliminate problems associated with manufacturing tolerances and improve the retention of the reservoir in the assembly 1, irrespective of the slight dimensional variations within a range of acceptable tolerances. The blades preferably extend axially over substantially the entire height below the shoulder 6 as far as the cutouts 33, 34. This improved retention due to the presence of the blades makes it possible, by changing only certain parts of the mold so as to make use of the length of the blades, to adapt the device according to the invention to reservoirs of different capacities without any substantial additional cost.

To use the assembly according to the invention, the user takes a reservoir 20 and introduces it into external casing 2 through opening 4. The protective cap sealing the reservoir is pierced by the free end of plunger tube 19. Reservoir 20 is then guided axially by the blades 36–39 until flange 26 enters into engagement with the skirt portions 27, 28 which move apart elastically to allow the flange 26 to pass and then return elastically into the rest position. In this position, reservoir 20 is retained in the external casing 2. The inwardly curved rim 30 of the liquid-tight skirt 29 is in liquid-tight bearing contact all around opening 25 of the reservoir. After use of the contents of the reservoir, the user takes hold of the bottle between the thumb and the index finger, in the region of the "U"-shaped cutouts, and extracts the empty reservoir by exerting axial traction on the reservoir, causing the flange 26 to pass the skirt portions 27, 28 by elastic deformation. The empty reservoir is thus freed. A new refill can be introduced in the manner indicated previously.

The assembly thus described is extremely simple to use. The cost, in particular, the cost of the disposable part of the device, is very low. The ergonomics of the dispensing of products packaged in very small volumes (for example less than 10 ml) can therefore be made similar to that of conventional products packaged in devices of greater capacity.

In the detailed description above, reference has been made to a particular embodiment of the invention. It is clear that variations can be made to this without departing from the spirit of the invention as claimed below.

What is claimed as new and desired to be secured by Letters Patent of the United States is:

1. An assembly for packaging and dispensing a product, comprising:

a reservoir containing a product, said reservoir including a body with a first closed end and a second open end defining an opening;

a pump; and a casing configured to receive said reservoir through an opening in a bottom of said casing and to enclose said reservoir over substantially an entire height of said reservoir, said pump provided on said casing, said casing including fastening means for releasably fastening said casing to said reservoir such that said reservoir communicates with said pump through said opening in said reservoir, said casing including at least one cutout in the vicinity of the bottom of said casing.

2. An assembly according to claim 1, wherein said product is a liquid product.

3. An assembly according to claim 1, wherein said at least one cutout is configured to assist the removal of the reservoir, for the purpose of replacing the reservoir.

4. An assembly according to claim 1, wherein said pump includes actuating and dispensing means.

5. An assembly according to claim 1, wherein said at least one cutout delimits elastically deformable portions, said elastically deformable portions configured to be deformed radially outwardly when said reservoir is inserted into said casing.

6. An assembly according to claim 1, wherein said fastening means comprises at least one elastically deformable member configured to interact by elastic deformation with a flange formed in the vicinity of said opening of said reservoir.

7. An assembly according to claim 5, wherein said fastening means comprises at least one elastically deformable member configured to interact by elastic deformation with a flange formed in the vicinity of said opening of said reservoir.

8. An assembly according to claim 1, wherein said casing includes a skirt having a free end configured to contact the opening of the reservoir so as to form a liquid-tight seal between said reservoir and said pump.

9. An assembly according to claim 5, wherein said casing includes a skirt having, a free end configured to contact the opening of the reservoir so as to form a liquid-tight seal between said reservoir and said pump.

10. An assembly according to claim 6, wherein said casing includes a skirt having a free end configured to contact the opening of the reservoir so as to form a liquid-tight seal between said reservoir and said pump.

11. Packaging and dispensing assembly according to claim 8, wherein a free end of said skirt forms a rim curved inwardly toward a longitudinal axis of said casing, and wherein said opening of said reservoir includes a chamfered portion forming a seat for said rim.

12. An assembly according to claim 1, further comprising means for guiding said reservoir into said casing and for providing resistance between said casing and said reservoir when said reservoir is being inserted into said casing.

13. Packaging and dispensing assembly according to claim 12, wherein said guide means comprises a plurality of blades arranged on an internal surface of lateral walls of said casing, said plurality of blades having free ends arranged so as to enter into elastic engagement with lateral walls of the reservoir along at least one line of contact.

14. Packaging and dispensing assembly according to claim 13, wherein said blades are arranged in a plane which does not pass through a longitudinal axis of said casing.

15. An assembly according to claim 14, wherein said casing includes at to least one portion with an oblong cross-section having a major axis, and wherein said blades are arranged in planes substantially perpendicular to said axis.

16. An assembly according to claim 1, wherein said casing comprises at least two cutouts, each of which form a substantially "U" shaped opening into the opening of the bottom of the casing, the two cutouts being arranged diametrically opposite one another.

17. An assembly according to claim 1, wherein said pump is provided with a plunger tube arranged to pierce a protective cap provided on the opening of said reservoir, when the reservoir is inserted into said casing.

18. An assembly according to claim 1, wherein said reservoir is glass.

19. An assembly according to claim 1, wherein said reservoir includes a profile capable of facilitating its being gripped by a user, facing the at least one cutout.

20. An assembly according to claim 1, wherein said pump is threadedly engaged with said casing.

* * * * *